US007033096B2

(12) United States Patent
Hetzer et al.

(10) Patent No.: US 7,033,096 B2
(45) Date of Patent: Apr. 25, 2006

(54) METHOD OF, AND CONFIGURATION FOR, OPENING A SECURITY HOUSING

(75) Inventors: Ulrich Hetzer, Berlin (DE); Uwe Hübler, Neuenhagen (DE); Frank Geserich, Friedrichsthal (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 0 days.

(21) Appl. No.: 10/850,416

(22) Filed: May 19, 2004

(65) Prior Publication Data

US 2004/0213621 A1 Oct. 28, 2004

Related U.S. Application Data

(62) Division of application No. 10/247,855, filed on Sep. 20, 2002, now Pat. No. 6,811,337.

(30) Foreign Application Priority Data

Oct. 2, 2001 (DE) ..... 101 49 210
Dec. 15, 2001 (DE) ..... 101 64 527

(51) Int. Cl.
*B41J 5/22* (2006.01)

(52) U.S. Cl. ..... 400/663; 400/664; 400/668; 400/693; 235/101; 235/130 R

(58) Field of Classification Search ..... 400/663, 400/664, 688, 693; 235/101, 130 R, 380, 235/382
See application file for complete search history.

(56) References Cited

U.S. PATENT DOCUMENTS 4,099,049 A 7/1978 Lowe
4,484,307 A 11/1984 Quatse et al.
4,767,228 A 8/1988 Harry
4,907,018 A * 3/1990 Pinkerpell et al. ..... 346/139 R
4,922,817 A 5/1990 Holodnak
5,093,560 A 3/1992 Abellana
5,365,312 A 11/1994 Hillmann et al.
5,467,709 A 11/1995 Salomon
5,509,117 A 4/1996 Haug
5,561,450 A * 10/1996 Brewster et al. ..... 347/49
5,671,146 A 9/1997 Windel et al.
5,689,098 A * 11/1997 Gillieron ..... 235/101
5,901,644 A * 5/1999 Etheridge et al. ..... 101/71

(Continued)

FOREIGN PATENT DOCUMENTS

EP 0 560 714 A2 9/1993

(Continued)

*Primary Examiner*—Andrew H. Hirshfeld
*Assistant Examiner*—Marissa Ferguson
(74) *Attorney, Agent, or Firm*—Laurence A. Greenberg; Werner H. Stemer; Ralph E. Locher

(57) ABSTRACT

A method of opening a security housing that requires authorization and unlocking moves the printing module transversely by a transverse mover into an additional unlocked position, as a result of which, the security housing or an access thereto is unlocked. The configuration has a mechanical locking or element and a printing module. The printing module is mounted such that it can be moved transversely to the transporting direction, for mechanically releasing the lock of a security-housing part directly or indirectly, by the security-housing part only being released once an additional security-housing part has been unlocked. The latter has a locking element that is disposed in the interior of the security housing and can be actuated by the printing module.

48 Claims, 6 Drawing Sheets

U.S. PATENT DOCUMENTS

| | | | |
|---|---|---|---|
| 5,956,056 | A | 9/1999 | Kaneko et al. |
| 6,041,704 | A | 3/2000 | Pauschinger |
| 6,102,524 | A | 8/2000 | Nakano |

FOREIGN PATENT DOCUMENTS

| | | | |
|---|---|---|---|
| EP | 0 610 684 | A1 | 8/1994 |
| EP | 0 875 861 | A2 | 11/1998 |
| EP | 0 875 862 | A2 | 11/1998 |
| EP | 0 875 865 | A2 | 11/1998 |
| EP | 0 881 086 | A2 | 12/1998 |
| EP | 0 881 599 | A2 | 12/1998 |
| EP | 0 969 421 | A2 | 1/2001 |

* cited by examiner

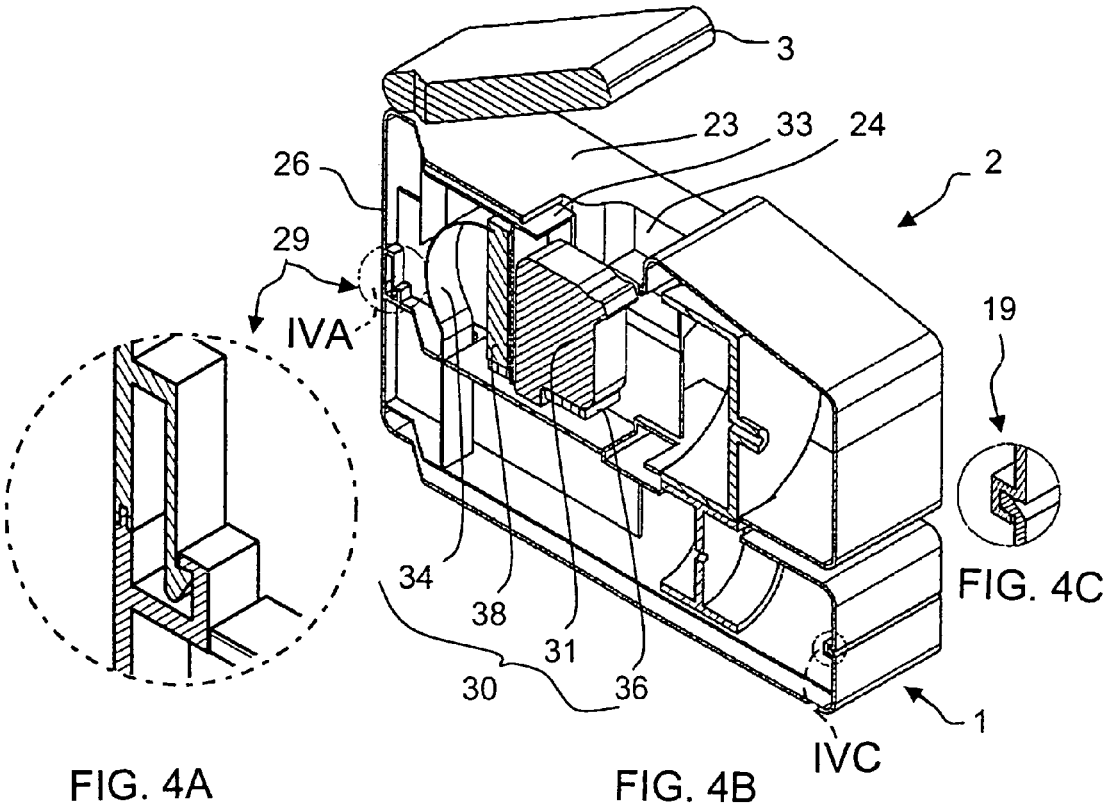
3
23
33
24
2
26
29
IVA
19
34
38
31
30
36
1
IVC
FIG. 4C
FIG. 4A
FIG. 4B
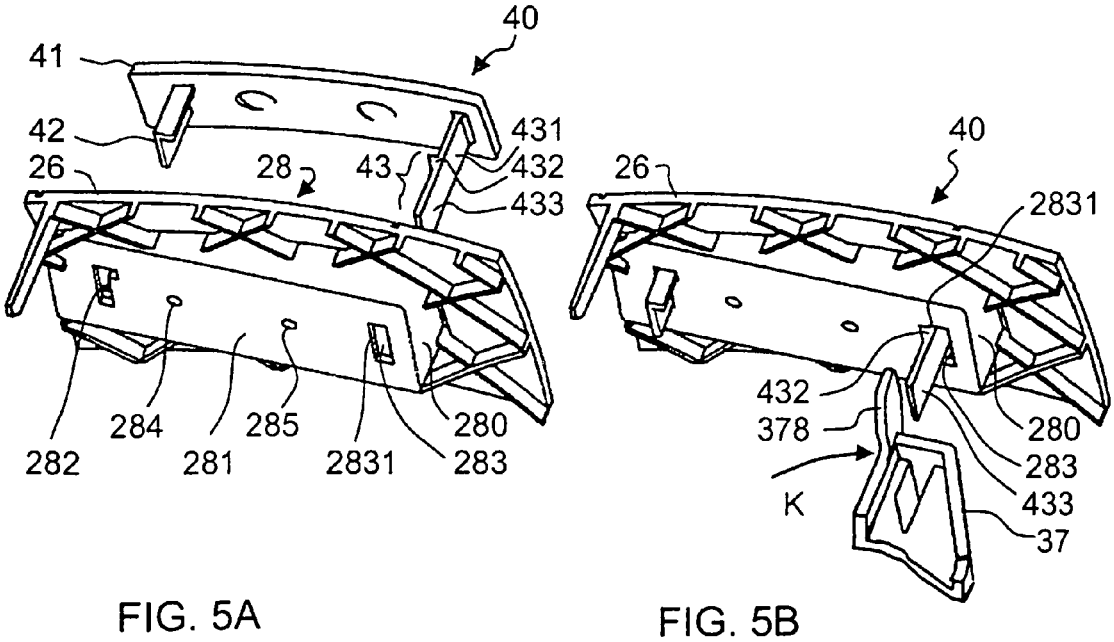
40
41
42
431
26
28
43
432
433
282
284
281
285
2831
280
283
40
26
2831
432
378
280
283
K
433
37
FIG. 5A
FIG. 5B

METHOD OF, AND CONFIGURATION FOR, OPENING A SECURITY HOUSING

CROSS-REFERENCE TO RELATED APPLICATION

This is a division of U.S. application Ser. No. 10/247,855, filed Sep. 20, 2002 now U.S. Pat. No. 6,811,337 This divisional application also claims the benefit of German application Nos. 101 49 210.3 and 101 64 527.9, filed Oct. 2, 2001, and Dec. 15, 2001, respectively, under 35 U.S.C. §119. The prior applications are herewith incorporated by reference.

BACKGROUND OF THE INVENTION

Field of the Invention

The invention relates to a method of opening a security housing that requires authorization and unlocking. The invention further relates to a configuration for opening a security housing with a mechanical locking device, having a printing module that can be moved transversely to a transporting direction. The invention is used for franking machines (i.e. postage meters), addressing machines, and other printing mail-processing machines with a security housing.

A heat-transfer franking machine, such as those sold under the trademark T1000 by the owner of the instant application, has a heat-transfer printing head that is disposed firmly in the housing and is intended for printing a franking imprint. The franking imprint contains previously input and stored postal information including the postal-charge data for sending the letter. A compartment positioned on the housing accommodates an exchangeable ink-ribbon cassette; see commonly-assigned U.S. Pat. No. 4,767,228. While a door leading to the compartment can be opened at any time, the access to the secure region of the printing device is prevented by a security housing.

If a franking machine is to be opened for repair purposes, break-off screws of the security housing have to be destroyed. In franking machines and other mail-processing machines with a security housing, it is also possible to use lead seals or plastic parts as a further prevention from access to the microprocessor control and to the activating lines of the fixed printing head. Following a repair which requires the security housing to be opened, it is necessary to replace break-off screws of the security housing, lead seals, or the plastic parts that served to prevent access.

The franking machine, sold under the trademark JET-MAIL® by the owner of the instant application, is provided with a base and with a removable meter. Only the latter is protected against misuse by a correspondingly constructed housing. The meter contains a controller, for controlling the printing and for controlling peripheral components of the franking machine, and a security module, which is provided with an accounting unit a cryptographic unit for safeguarding the postal-charge data that are to be printed. Additional mechanical protection is provided by the security module that is encapsulated in a further housing. In contrast to this, the housing of the base need not have any protective function and may be constructed such that it is easy to repair. The base contains a mail-transporting device and an ink-jet printing device for printing the postal stamp on the item of mail. It is not necessary for the printing head to be exchanged since the ink tank is disposed separately from the printing head and can be exchanged. It is not necessary either to take any specific security measures for the printing head or for protecting the activating and data signals if a specific piezo ink-jet printing head is used to print a security imprint with a marking that makes it possible to verify the authenticity of the security imprint; see commonly-assigned U.S. Pat. No. 6,041,704. The production of an inauthentic security imprint, however, is thus merely made more difficult and is not prevented right from the start. Satellite Bubble-jet printing heads are also used in the printing module in franking machines (for example, those sold by the assignee of the instant application under the trademark MYMAIL®, PERSONAL POST™ from Pitney Bowes and the PORTOSTAR from Neopost). The ink tank and bubble-jet printing head are integrated in an exchangeable ink cartridge, as is already known, for example, from the ½-inch ink cartridges such as those sold by HEWLET PACKARD® (HP). The contact connection of the electrical contacts of the printing head of the exchangeable ink cartridge can take place via a connector of a commercially available pen driver board from HP. On account of it being possible for the ink cartridge to be exchanged easily by the user, there are new possibilities for an inauthentic security imprint being produced, for example by further printing modules being operated with printing data that are only intended for a certain printing module (replay attack). According to U.S. Pat. No. 5,365,312, an ink cartridge of the printing module has a chip with readably stored identification data in order to authorize the ink cartridge for printing when it is inserted into the printing module. Some postal authorities impose relatively stringent requirements on the authorization of franking machines, which causes the manufacturers of the latter to provide such ink cartridges with additional security devices or to take suitable protective measures, so that it is not possible either to manipulate ink cartridges, or to influence the printing operation directly, in order to print franking imprints without paying for them. The franking machine is intended to rule out the use of a "foreign" ink cartridge. According to European Patent No. EP 875 862 A2, which corresponds to U.S. Pat. No. 6,212,505, a reader of the franking machine guarantees that unique identification data of the ink cartridge are read and the authorization for utilizing the latter in the franking machine is checked. According to U.S. Pat. No. 5,956,056, which corresponds to European Patent No. EP 881 599 A2, a check is made as to whether an ink cartridge has been installed. If not installed, then an accounting module is blocked for the token production. In addition to the purely electronic solutions, solutions that mechanically prevent impermissible activation of a further printing module with the printing data during the printing operation are also already known. According to U.S. Pat. No. 6,102,534, which corresponds to European Patent No. EP 875 861 A2, a franking machine can only be operated to produce franking imprints when a hatch has been closed. Transverse movers allow the printing module with the ink cartridge to be displaced into a region adjacent to the printing region in order for the ink cartridge to be removed or exchanged. The hatch, which is disposed in the security housing, can only be opened if the printing module with the ink cartridge has been displaced into the adjacent region. In the other cases, the hatch is closed by a closure. According to European Patent No. EP 875 865 A2, access to the printing module with the ink cartridge is barricaded with a hatch, and the hatch can only be opened in response to an authorization signal that lifts the barricade, this allowing the ink cartridge to be removed or exchanged. Direct access to the secure region of the machine housing is not envisaged in any of the abovementioned solutions.

SUMMARY OF THE INVENTION

It is accordingly an object of the invention to provide a method of, and a configuration for, opening a security housing that overcome the hereinafore-mentioned disadvantages of the heretofore-known devices of this general type and that allow easy access for a servicing technician to essential parts within the security housing for repair and maintenance purposes. This access is to be barred to the user. It is additionally intended to develop an access-preventor that bars the user from access to sensitive digital supply lines for activating the ink-printing head of the ink cartridge. However, the ink cartridge should remain removable or exchangeable.

With the foregoing and other objects in view, there is provided, in accordance with the invention, a method of opening a security housing with authorization and unlocking. The first step of the method is providing a print module that is transversely movable by a transverse mover. The next step is bringing the printing module into an unlocked position by moving the printing module in a direction transverse to a mail-transporting direction. The final step is releasing mechanically a security-housing part by completing the bringing step.

With the objects of the invention in view, there is also provided a configuration for franking device security. The configuration includes a security housing, a printing module, a mechanical lock, and a finger. The security housing has a mechanical locking device and defines an interior. A printing module is movable by a transverse mover transversely to a transporting direction across a displacement path. The printing module is movable into an unlocked position located at an end of the displacement path. The mechanical lock is disposed on a respective security-housing part or in the interior of the security housing. The finger is disposed on the printing nodule for actuating the mechanical lock.

With the objects of the invention in view, there is also provided a further embodiment of a configuration for franking device security. The configuration includes a security housing, a printing module, an element, and a finger. The security housing has a mechanical locking device and defines an interior. The printing module is movable by a transverse mover transversely to a transporting direction across a displacement path, the printing module being movable into an unlocked position located at an end of the displacement path. The element is disposed on a respective security-housing part in the interior of the security housing. The finger is disposed on the printing nodule for actuating the element.

At least one secure region and one non-secure region are located within the security housing. Only authorized individuals, such as servicing technicians, are authorized to access both regions. This is based on the consideration that a mechanical release is triggered in the interior of the security housing. The power of a drive for moving the printing module transversely brings the latter into a specific unlocked position, with the result that the printing module unlocks at least one security-housing part or an access thereto. This configuration obviates an additional activator for unlocking purposes. Unlocking requires a preceding authorization check for example by a franking machine or meter or by a remote central data unit. From this, it is possible for at least a first access to at least one lock of the security-housing part to be released mechanically. It is also provided that, in the case of mechanical release of the security housing or access thereto, activation of an ink-jet printing head of an ink cartridge is prevented. It is advantageous if a sensor is provided and a check is made as to whether the security housing of the postal machine is released or locked. Once the locking has been checked, the postal machine can be operated for franking items of mail if proper locking has taken place. A further sensor can confirm that a mechanically released access for changing an ink cartridge has been relocked before allowing operation of the postal machine. The printing module can be displaced, by a transverse mover, basically:

from a home position into a printing position for printing purposes, from a home position or from the printing position into an unlocked position for releasing the security housing or the first access to the security housing, or into a changeover position for changing the ink cartridge.

The printing position and the unlocked position form the end points of the displacement part of the printing module, the ink-cartridge changeover position being located between the printing position and the unlocked position or the home position and the unlocked position.

The printing module can be displaced first of all, in the X-direction, into the unlocked position and then, counter to the X-direction, into the changeover position for ink cartridges. Thus, on the one hand, the locking of the security housing is mechanically released directly or an access to the security housing is in the unlocked state. On the other hand, in the case of a printing module parked in the changeover position, an ink cartridge can be removed or exchanged.

It is provided that, as a result of a transverse movement of the printing module into the unlocked position, a first access for an authorized individual to components within the security housing for repair and maintenance purposes and a second access are released mechanically, the second access being accessible for the purpose of changing an ink cartridge.

The ink-jet printing head can form a constituent part of a postal ink cartridge having special electrical and mechanical features which distinguish it from the conventional ink cartridges. The special features are provided for automatic and/or easy recognition of the postal ink cartridge by the postal machine and/or by the user. Further electronic and mechanical protective measures are provided in conjunction with the printing module, which has to be brought into a predetermined changeover position in order to allow the ink cartridge to be exchanged.

The second access for changing an ink cartridge is already released mechanically when the printing module passes through the changeover position during the transverse movement or when the printing module is only moved transversely into the changeover position, that is to say when an unauthorized individual initiates a transverse movement of the printing module for example prior to operation of the postal machine for franking items of mail. The user thus only has access to non-secure regions of the machine, for example for changing expendable material, such as franking strips or ink cartridges, for changing batteries or the like. Located in the top housing part of the franking machine is a corresponding opening for changing the ink cartridge. Following input of an (unauthorized) signal, the printing carriage with the ink cartridge is displaced into a changeover position, from which the ink cartridge can be removed or exchanged. A flap that covers the abovementioned opening is provided for the user. The flap can be opened at least when the printing carriage has been displaced into the changeover position for changing the ink cartridge or into the adjacent additional unlocked position. Alternatively, the flap is not a constituent part of the security housing and/or can be opened or removed at any time. When the printing carriage is brought into a printing position for printing purposes, a protective cap prevents access to the control lines during the printing operation. The protective cap is fastened on the printing carriage and closes the abovementioned opening in the housing, corresponding to the movement of the printing carriage in the direction of the printing position. In the case of any other position into which the printing carriage can be brought, the abovementioned opening is not, or not completely, closed by the protective cap.

Alternatively, a security-housing part bars the user from a first access to the interior of the mail-processing machine and covers a disengageable further lock. The disengageable further lock is disposed on a wall of a bottom housing part or top housing part of the security housing. Both the bottom and top housing parts are located in the interior of the security housing. The disengageable further lock enables the security housing to be locked or unlocked manually. At least one mechanical locking element is disposed on the security-housing part. The mechanical locking element is provided with a hook nose at the end of the resilient extension arm. The hook nose can engage the abovementioned wall located in the interior of the security housing. Whenever, the security-housing part is removed, destruction is evident. The top security-housing part has an opening to allow restricted second access to the interior of the mail-processing machine to permit changing of the ink cartridge. The opening can be closed by a flap that has a stop. When the flap is opened, the stop actuates a switch that is disposed in the interior of the security housing. The switch interrupt the power supply to a motor of the transverse mover of the printing module. A protective sheath and a protective cap are fastened to the printing module in order to prevent unauthorized access to the strip conductor and to the electronic activating unit.

Other features that are considered as characteristic for the invention are set forth in the appended claims.

Although the invention is illustrated and described herein as embodied in a method of, and a configuration for, opening a security housing, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4A is an enlarged partial view of the closed lock of the security housing;

FIG. 4B is a sectional view of the franking machine in the region of the opening with the printing module positioned in an ink-cartridge changeover position;

FIG. 4C is a partial sectional view of a connector for connecting the top and bottom housing parts;

FIG. 5A is an exploded view of the access to the lock closed by the access-prevention part;

FIG. 5B is a perspective view showing an access to the lock and the mechanical release to the access;

DESCRIPTION OF THE PREFERRED EMBODIMENTS

Figure 1A:
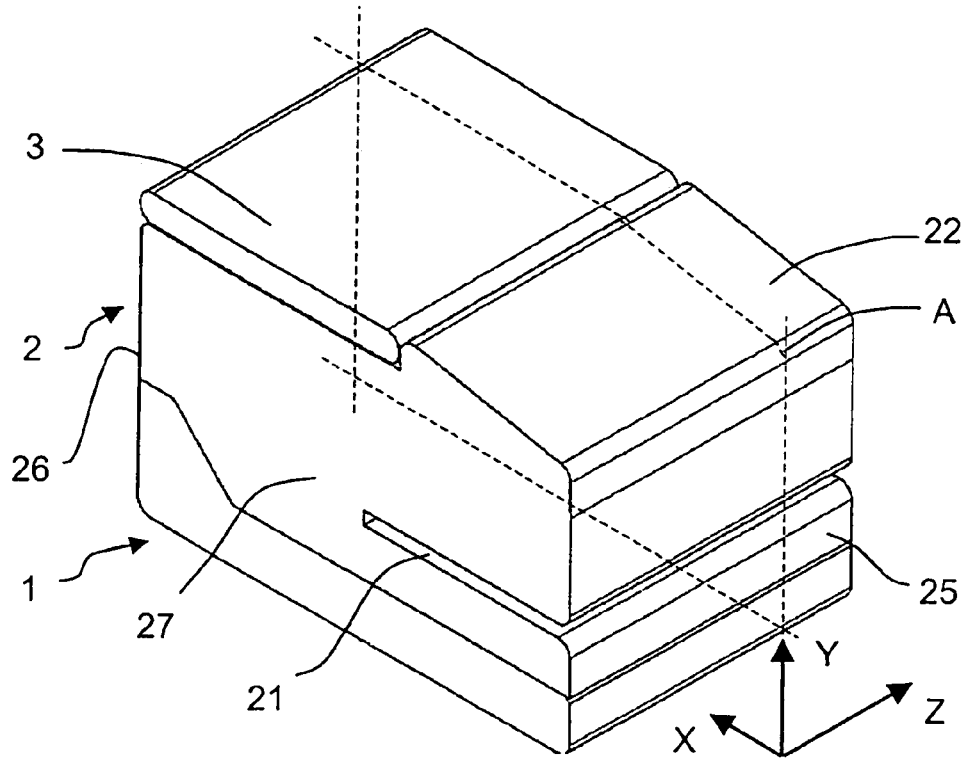
FIG. 1A is a diagrammatic perspective view showing a franking machine with flap according to the invention.

Referring now to the figures of the drawings in detail and first, particularly to FIG. 1A thereof, there is shown a perspective view of a franking machine with a removable top housing part 2. The top housing part 2 is disposed above a bottom housing part 1, as seen in the Y-direction. The front side 25, the mail-inlet side 27 and the mail-outlet side (not visible) of the top housing part 2 have a slit-like opening 21 for an item of mail which is to be franked and can be fed in the Z-direction. The top housing side has a surface 22 that is inclined in the direction of the front side 25 and is suitable for accommodating a user interface (not shown). A lid-like flap 3 is disposed on the top housing side 23, which adjoins the inclined housing surface 22 in the X-direction. The rear housing side 26 is constructed in a suitable manner for accommodating a lock (shown in FIGS. 2A, 3A and 4A) that can lock or unlock the housing part 1, 2. The section surface A located along the XY-plane is only depicted in FIG. 1A. FIGS. 2A to 4B show a view inside a franking machine, the latter having been sectioned along the XY-plane.

Figure 1B:
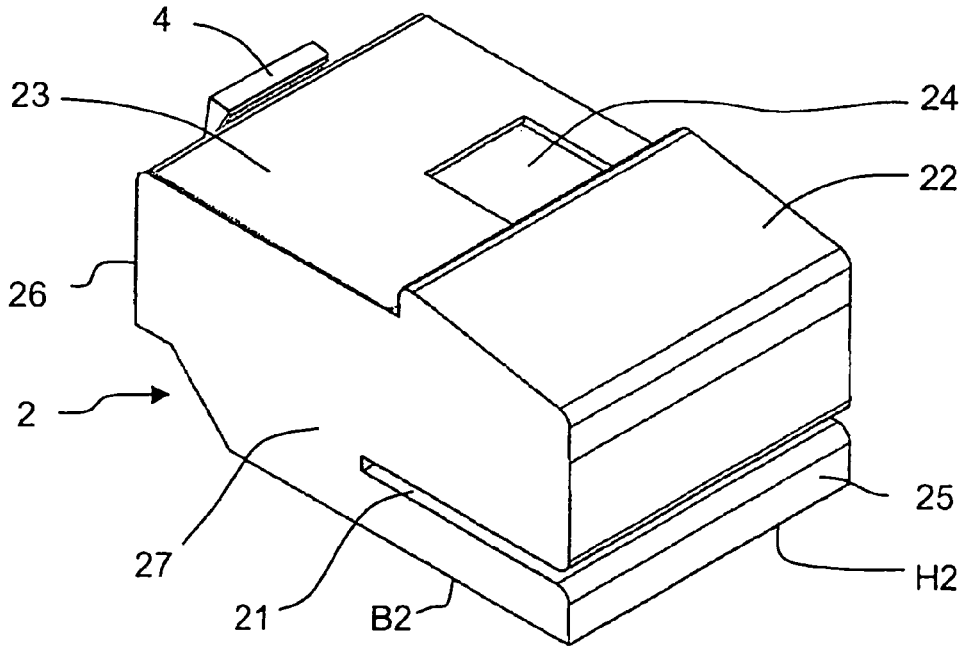
FIG. 1B is a perspective view showing a removable top housing part of the franking machine.

FIG. 1B shows a perspective view of the removable top housing part 2 with the slit-like opening 21 on the front side 25, the mail-inlet side 27 and the mail-outlet side (not visible) of the top housing part 2, with the rear housing side 26, with the inclined housing surface 22 and the top housing side 23. The top housing side 23 is shown without the flap and has an opening 24 that is bounded by the inclined housing surface 22. In addition, it is possible to provide at least one releasable security-housing part 4 that must-be released before the top housing part 2 can be removed.

The removable top housing part 2 is open at the bottom and has a peripheral border B which is the same all the way round with the exception of the border H on the front side, the configuration of which is explained in more detail with reference to FIG. 2C. Before the top housing part 2 can be removed, an authorization check has to be carried out by the franking machine or meter of the franking machine or via franking machine or meter by a remote central data unit. The central data unit and of the control unit of the franking machine may enact the authorization check. The control unit can distinguish between authorized opening (servicing, inspection) and unauthorized opening (with the intention of manipulation), in conjunction with the data transmitted from the central data unit and with a signal detected via a sensor, as has already been described under the title: "Verfahren zur Verbesserung der Sicherheit von Frankiermaschinen gegen Manipulation" [Method of Improving the Protection against Manipulation in Franking Machines] in European Patent No. EP 969 421 A2 (or in U.S. Pat. No. 5,671,146).

Figures 2A, 2B, 2C:
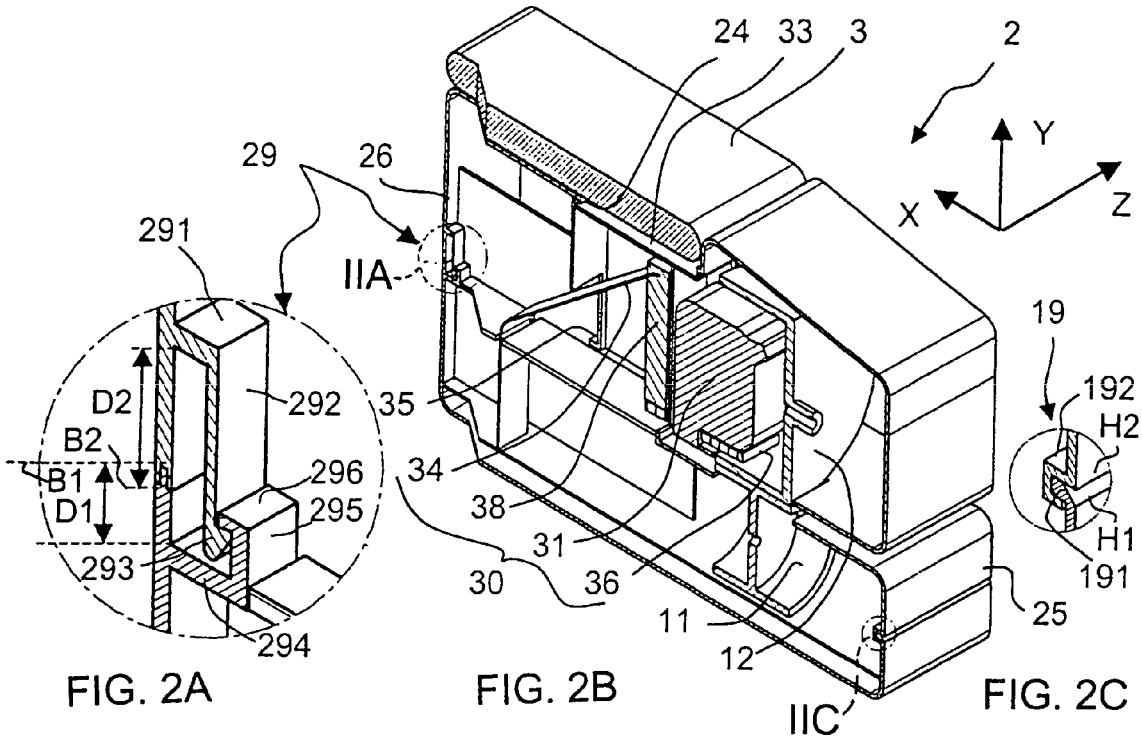
FIG. 2A is an enlarged partial view showing the locking of the security housing.
FIG. 2B is a sectional view through the franking machine with the printing module being positioned in the printing position.
FIG. 2C is an enlarged partial view of a connector for connecting the top and bottom housing parts.

FIG. 2A illustrates in more detail the lock 29 of the security housing depicted in the locked state. At a predetermined distance D2 from a border B2 of the removable top housing part 2, a crosspiece 291 is disposed parallel to the XZ-plane and is adjoined, counter to the Y-direction, by a spring plate 292. The spring plate 292 is located parallel to the YZ-plane, a hooknose 293 is disposed at the end that is located counter to the Y-direction. The border B2 of the removable top housing part 2 has a U-shaped groove around the two sides and the rear. A matching tongue is made in the border B1 of the bottom housing part 1. At a predetermined distance D1 from the border B1 of the bottom housing part 1, a crosspiece 294 is disposed parallel to the XZ-plane and is adjoined at right angles, in the Y-direction, by a stop 295. The stop 295 is located parallel to the YZ-plane, a hook 296 being disposed at that end of the stop 295 that is located in the Y-direction. When the top housing part 2 is installed on the bottom housing part 1, the spring plate 292 is deflected in the X-direction on account of the slope on the hook nose 293, which slides along the hook 296. The lock 29 locks the security housing when the spring plate 292 strikes against the hook 296. This embodiment is also referred to as a snap-in connection.

FIG. 2B shows a section through the franking machine. A printing device is visible in the cut-open housing. An item of mail (not shown) is transported in the transporting direction Z through a driven transporting drum 12, which is disposed opposite at least one spring-mounted backpressure roller 11, which is not driven. The printing module 30 is disposed such that it can be moved in the X-direction and counter thereto, and thus transversely to the transporting direction Z, and has at least one exchangeable ink cartridge 31 which, in the printing position, partially projects into a transporting drum 12. More specific details in this respect can be gathered from German Patent No. 100 32 855.5, which was not published before the priority date and is entitled: "Vorrichtung zum Bedrucken eines Drucktragers" [Device for Printing a Printing Carrier].

The opening 24 for the purpose of changing the ink cartridge 31 is concealed by the flap 3. No closure is provided for such a flap 3. Although the transversely movable printing module is disposed in the region of the opening 24 for the purpose of changing the ink cartridge 31, the latter cannot be changed in the printing position. The printing module 30 includes an electronic activating unit 38, which is connected to the control unit (not shown) of the franking machine via a strip conductor 34, and a printing carriage 36, which is guided, for example, on rails (not shown) and, as is known, can be displaced from a home position into a printing position or, for the purpose of changing the ink cartridge, into a changeover position. When the printing carriage is brought into a printing position for printing purposes, the protective cap 33 prevents access to the strip conductor 34 and the control lines in the electronic activating unit 38 during the printing operation. The protective cap 33 has an actuating finger 35 and is fastened on the printing carriage 36. When the printing carriage 36 is moved into the printing position, the abovementioned opening 24 in the housing is closed, the protective cap 33 being pushed beneath the opening 24. In any other position into which the printing module 30 can be brought, the abovementioned opening 24 is not, or not completely, closed by the protective cap 33. The inner wall of the rear housing side 26 is constructed with at least one lock 29, which locks or unlocks, for example, the top housing part 2.

FIG. 2C shows a view, in detail form, of a connector 19 for connecting the top and bottom housing parts on the front side 25. The border H1 of the bottom housing part 1 is constructed as an inwardly curved bead 191, which is enclosed in a U-shaped manner by the border H2 of the top housing part 2. As long as the lock 29 of the top housing part 2 is locked, a form-fitting and force-fitting connection is present. The U-shaped opening of the enclosure 192 on the border H2 of the top housing part 2 is made in the X-direction and gives the border H2 of the top housing part 2 a hinge function, for swinging up during rotation via the border H1 once the lock 29 of the top housing part 2 has been unlocked. It is only when the top housing part has been swung up to a predetermined angle in relation to the bottom housing part 1 that the connection to the bottom housing part 1 can be fully disengaged.

Figures 3A, 3B, 3C:
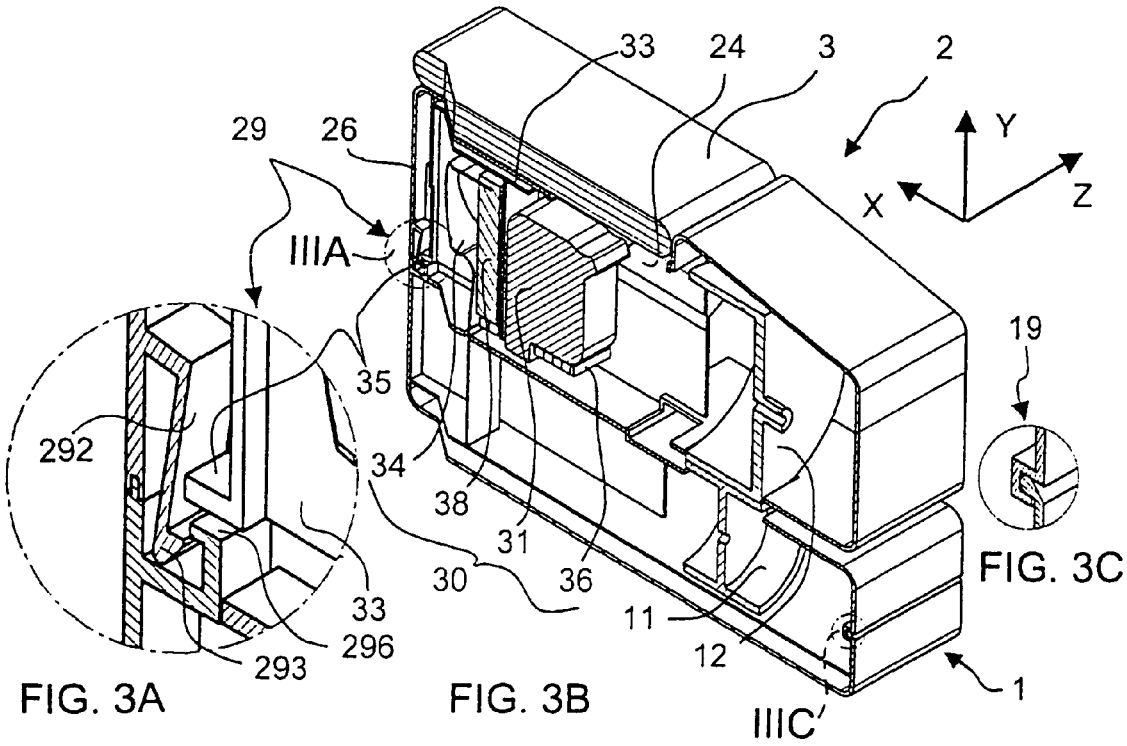
FIG. 3A is an enlarged partial view showings the open lock of the security housing.
FIG. 3B is a section view through the franking machine with the printing module positioned in an unlocked position.
FIG. 3C is an enlarged partial view of a connector for connecting the top and bottom housing parts.

FIG. 3A shows an illustration of the open lock 29 of the security housing. When the printing module reaches the additional unlocked position, the finger 35 of the pusher 33—as is shown—strikes against the spring plate 292, the hook nose 293, which is disposed at the end of the spring plate 292, unhooking from the hook 296.

FIG. 3B shows a section through the franking machine, the printing module being positioned in an unlocked position. The printing module 30, which can be moved transversely to the transporting direction and has at least one exchangeable ink cartridge 31, has previously been displaced in the X-direction, during a transverse movement from the printing position or a home position in the vicinity of the transporting drum 12, as far as the unlocked position in the vicinity of the rear housing side 26. Although the flap 3 can be opened, the ink cartridge 31 cannot be exchanged. The printing module 30, which is moved in the X-direction for this purpose, is still visible through opening 24 because the abovementioned opening 24 is not closed by the protective cap 33. Nevertheless, neither the connection lines of the strip conductor 34 nor the electronic activating unit 38 can be reached through the opening 24 if a printing module 30 is located in the unlocked position. The top housing part 2 is unlocked by the at least one lock 29, which is formed on the inner wall of the rear housing side 26, as soon as the printing module 30 passes into the unlocked position and the finger 35 of the protective cap 33 deflects the spring plate 292 and thus opens the snap-in connection. The security housing can then be swung up in the Y-direction during rotation of the top housing part 2 about an axis of rotation located parallel to the Z-direction (along the connector 19).

FIG. 4A illustrates the lock 29 of the security housing in the locked state again, the latter having already been explained in more detail with reference to FIG. 2A. If the printing module 30 (as is shown in FIG. 4B) has only been displaced into a changeover position for ink cartridges, the locked state is still maintained. It is thus only possible for a user to change the ink cartridges.

FIG. 4B shows a section through the perspective view of the franking machine in the region of the opening 24, the printing module 30 being positioned in the ink-cartridge changeover position. It is provided that the printing position and the unlocked position form the end points of the displacement path of the printing carriage 36, the ink-cartridge changeover position being positioned between the printing position and the unlocked position or the home position and the unlocked position. The ink-cartridge changeover position is located between the printing position and the unlocked position or the home position and the unlocked position such that the opening 24 in the top housing side 23 is located above the ink cartridge 31 by precisely the extent which allows the latter to be changed. This second access provided by the opening 24 is constructed such that it can be at least partially closed by the protective cap 33 when the printing module 30 is positioned outside the ink-cartridge changeover position. Thus, neither the connection lines of the strip conductor 34 nor the electronic activating unit 38 are accessible through the opening 24 when the flap 3 is open. The bottom housing part 1 and the top housing part 2 are connected to one another by the connector 19 and the locked lock 29.

If the printing module 30 has been displaced first of all into the unlocked position (shown in FIGS. 3A and b) and then into the changeover position for ink cartridges, the housing parts 1 and 2 and the flap 3 are in the unlocked state. This makes it possible for a servicing technician not just to open the security housing but also to change the ink cartridge.

In a further variant (not shown), at least one lock 29 is formed as a snap-in connection, or in some other suitable manner, on the inside of one of the walls of the security housing. The inside of the walls on the front side 25, rear side 26, or mail-inlet side 27 and/or mail-outlet side, top side and/or underside are constructed correspondingly with a lock that can be actuated from the inside, the drive power of the transverse mover for moving the printing module 30 transversely being transmitted to the at least one lock 29 via a force-transmitter when the printing module 30 is brought into the unlocked position. As a result, at least one security-housing part or an access thereto is released mechanically. The force-transmitter is, for example, a lever, a cable pull, or a similarly acting devices.

In an alternative variant that is not shown, at least one locking element is constructed with a hook on a resilient extension arm, which is fitted on a security-housing part 4 and is deflected by the transverse movement of the printing module 30 into the unlocked position. When the locking element is actuated, the security-housing part 4, and thus an access to a further lock of the security housing, is released mechanically. The further lock is provided on at least one of the walls (front side 25, rear side 26, mail-inlet side 27 and/or mail-outlet side, top side and/or underside) of the security housing, in order for at least one security-housing part to be locked or unlocked manually. The access provided is an opening 28 (not illustrated) in one of the housing surfaces of any security-housing part. The security-housing part 4 for closing the access is, for example, an access-prevention part with plate.

FIG. 5A illustrates a perspective view, from beneath, of an access-prevention part that covers an access to at least one disengageable further lock of a security housing from the outside. The access is located, for example, on the rear housing side 26, only part of which is illustrated. The access to disengageable further lock is constructed as a compartment 280 with a base 281, which has further openings 282, 283, 284 and 285. The openings 284 and 285 are provided for the disengageable further lock of the security housing. In the simplest case, screws (not illustrated) are used as the disengageable further lock.

The access-preventing part 40 has an access-prevention plate 41 of the same size as the window-like opening 28 (not visible on the rear housing side 26) and guide and locking elements 42, 43 that are directed into the housing interior. The locking element 43 is fitted resiliently, and the guide element 42 is fitted rigidly, on the access-prevention plate 41. The openings 282, 283 in the base 281 are formed to correspond to the shape of the guide and locking elements 42, 43. The guide element 42, with a predetermined length, is, for example, L-shaped or U-shaped, which increases its rigidity. The locking element 43 is of plate-like form and includes a spring plate 431 that is integrally formed on the access-prevention plate and has a hook nose 432 that is spaced apart from the access-prevention plate 41, the spring plate 431 merging into a plate-like stop 433 as the distance from the access-prevention plate 431 increases. The hook nose 432, engaging in a corresponding housing edge 2831 or a hook (not shown), can lock the access-prevention part 40 in the security housing: the access-prevention plate 41 is provided in order to close the window-like opening 28 on the rear housing side 26.

FIG. 5B shows an illustration of an access to the lock. Of the access-prevention part 40 concealing the opening 28, only the guide and locking elements as well as mechanical releases for accessing the compartment 280 are visible. The hook nose 432 of the locking element is latched into a corresponding housing edge 2831 of the opening 283. By virtue of the plate-like stop 433, the spring plate 431 can be deflected level with the hook nose 432, with the result that the hook nose 432 disengages from the housing edge 2831 or the hook, which is not shown. The access-prevention part 40 has now been unlocked and can be removed. The mechanical release for the access 280 is, for example, a lever 37 with a finger 378, which presses on the plate-like stop 433 by the force A as soon as the lever 37 is deflected sufficiently by the transverse movement of the printing carriage 36. The transverse movement of the printing carriage 36 (not shown) takes place from mechanically releasing the access-prevention part 40. The access-prevention part 40 and the lever 37 may be produced as plastic parts. An outer layer (not illustrated) made of a hard material may be applied, as further mechanical protection, to the access-prevention plate 41.

In an alternative variant that is not shown, it is possible to dispense with the lever 37 if the spring plate 431, which is extended by using the plate-like stop 433, is deflected sufficiently by the transverse movement of the printing carriage 36, which is provided with a corresponding finger 35, in order to release the access-prevention part 40 mechanically.

As an alternative to this, it is possible (in a manner similar to that illustrated in FIGS. 3A and b) for the protective cap 33, which is fastened on the printing carriage 36, to have a finger 35 for releasing the security housing or an access thereto.

Figure 6:
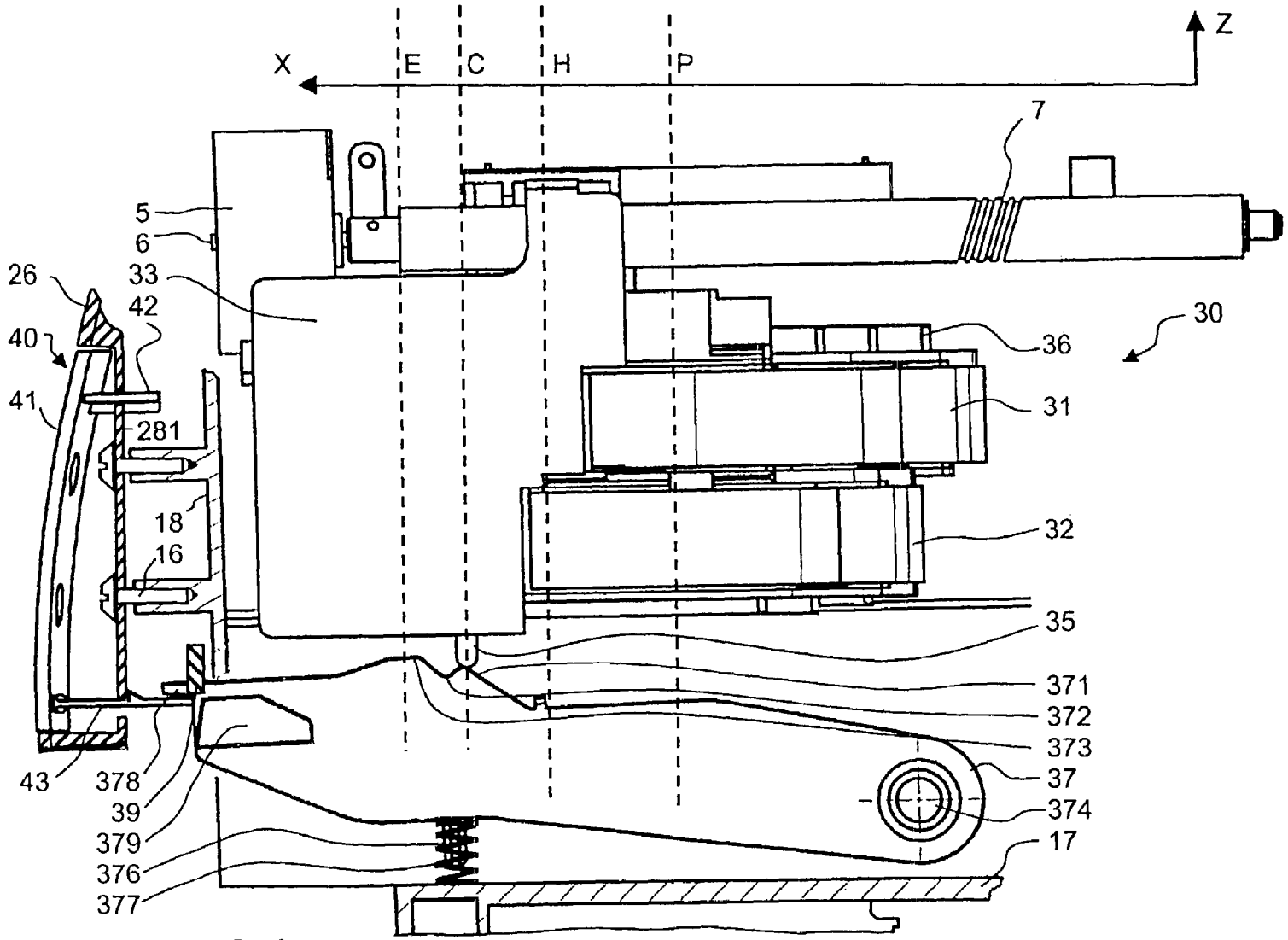
FIG. 6 is a left side view showing an actuating mechanism for the access-prevention part.

FIG. 6 shows an illustration of an actuating mechanism for the access-prevention part in plan view. An access-prevention part 40, with access-prevention plate 41 and guide and locking elements 42, 43 which are directed into the housing interior, is illustrated in a state in which it has been latched into a compartment-like depression of the rear housing wall 26. The latter is fastened on the chassis part 18, for example, by being screwed in. For illustrative purposes, a section through the screw 16 on the base 281 of the compartment-depression is shown. The access-prevention part 40 can only be released from the inside. The drive power of the motor 5 rotates a drive spindle 7 fastened on the pin 6 and moves the printing module 30.

The printing module 30 is moved, for example, in the X-direction and, starting from the printing position P, passes successively through the home position H, the changeover position C and the unlocked position E.

The printing carriage 36 of the printing module 30 is mounted such that it can be moved back and forth on a slide rail that is not illustrated, and bears two ½inch bubble-jet ink cartridges 31 and 32. A protective cap 33 and a finger 35 are fastened on the printing carriage 36. The protective cap 33 blocks access to the activator of the ink cartridges 31 and 32 when the printing module 30 is positioned outside the ink-cartridge changeover position or in the printing position P or home position H. A lever 37, which can be deflected in the Z-direction at one end, has a swivel pin 374 in the Y-direction, in the vicinity of the wall on the front side of the security housing, at its other end. In the X-direction, at a distance from the swivel pin, the lever 37 has an extension element 376. The latter bears a spring 376 for resiliently supporting the lever 37 on the chassis side part 17, with the result that the lever 37 is pressed, by way of its guide elements 371, 372, 373, onto the finger 35 of the printing carriage 36 of the printing module. The finger 35 is moved in the X-direction and slides along the guide segment 371 when the printing module 30 reaches the changeover position C.

It is provided that the opening 24 can be closed by a flap 3 which is provided with a stop 39 which is disposed on the flap 3 such that it can be locked by a second finger 379 of the lever 37, the locking being eliminated when the printing module 30 is positioned in the ink-cartridge changeover position C or in the unlocked position E. The lever 37 bears, the end opposite to the swivel pin, a first finger 378 and the second finger 379 and is deflected counter to the spring force in accordance with the curved shape of the guide segment 371. The second finger 379 which is moved as a result releases the stop 39 of the flap 3 (not shown), with the result that the flap 3 can be moved from a closed initial state into an open state.

However, when the printing module 30, leaves the changeover position C—in a manner which is not shown, the printing module 30 being moved further in the X-direction and the finger 35 then sliding along the guide segment 372, the lever 37, on account of the spring force, is deflected in the Z-direction in accordance with the curved shape of the guide segment 372 and the stop 39 of the flap 3 is kept in the initial state again by the second finger 379.

In an alternative variant that is not illustrated, the flap 3 cannot be locked and the opening 24 is accessible at any time, because the second access is already restricted by the protective cap 33.

If the printing module 30 is brought into the unlocked position E by being moved further in the X-direction, the finger 35 will slide along the guide segment 372 and the lever 37 is deflected counter to the Z-direction, and the action of spring force, in accordance with the curved shape of the guide segment 372. The finger 378 deflects the locking element 43, as a result of which the access-prevention part 40 is unlocked and the first access (opening 28) to the top security-housing part 2 is freed. The top housing part 2 is released indirectly once the mechanical locking element 43 in the interior of the security housing has been actuated by the printing carriage 36 via the first finger 378, which is disposed on a lever 37.

In an alternative variant that is not illustrated for the transverse mover, a motor 5 acts, for mechanical driving, on the printing module 30 via a toothed belt.

Figure 7:
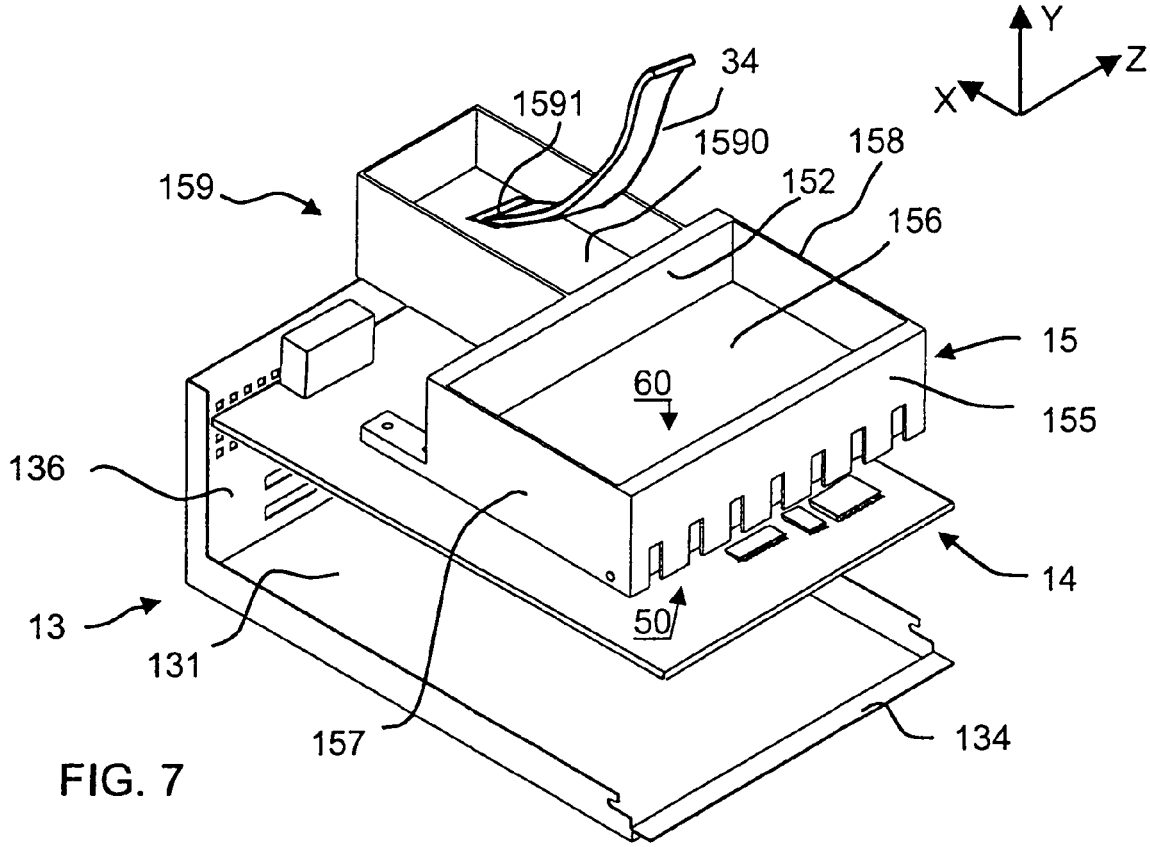
FIG. 7 is an exploded perspective view of a chassis configuration.

A perspective view of a chassis configuration in an exploded illustration in FIG. 7 shows the mechanical protection of a printed circuit board that is disposed in the inner secure region of a franking machine and bears a control unit of the franking machine. Disposed above a bottom shell 13, which is formed for protective and supporting purposes, and a printed circuit board 14, on which the components of the inner secure region are connected up to one another, is a top shell 15, which is formed correspondingly for protective and supporting purposes. The chassis shells 13 and 15 may have a group of outer air-admission openings that are disposed in a row and are preferably made in the form of slots on the outer border. The bottom shell 13 includes a shielding and supporting plate 131, which is parallel to the bottom housing part 1, and a rear shielding- and supporting-plate part 136, which is angled parallel to the rear housing side 26 and at least has openings for supplying power via a power plug cable and for channeling away a heated air stream to the outside. The security-specific components disposed on the printed circuit board 14, in the assembled state, are covered over in a box-manner by the chassis part. In the assembled state, the printed circuit board 14 rests on the front of the skirt 134 of the bottom shell 13. The top chassis shell 15 is supported, by way of its side walls, on the printed circuit board 14.

On the inlet and outlet sides of the mail stream, the top chassis shell 15 is bounded in each case by a respective side wall 157 and 158 and by a front side wall 155 and by a side wall 152 parallel thereto. An inner cavity is divided up into a bottom cavity 50 and a top cavity 60 by a plate 156 which is located parallel to the shielding and supporting plate 131. The bottom cavity 50 is provided for accommodating an electronic controller for the printing operation, the controller being located in the inner secure region. The top cavity 60 is provided for accommodating a pressure-exerting mechanism for the transportation of the mail. In addition, a box 159 is disposed on the top chassis shell 15, and extends, for example, in the X-direction to the rear housing wall 29. If the box 159, as is shown, has a box base 1590, then the latter contains at least one opening 1591 for electric cables of the printed circuit board 14 in the form of a strip conductor 34. A supporting frame 10 (FIG. 8) is disposed above the top chassis shell 15 as a further chassis part for supporting the printing mechanism.

Figure 8:
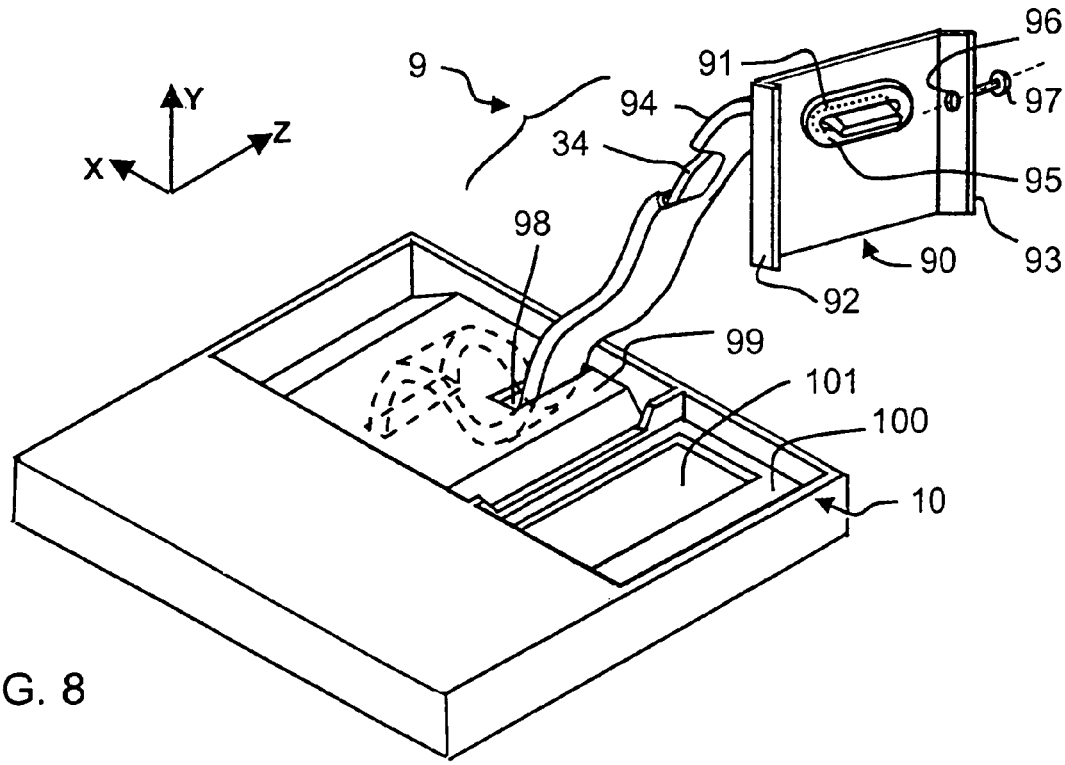
FIG. 8 is a perspective view showing a protective sheath for a strip conductor.

FIG. 8 shows a protective sheath 9 for a strip conductor 34, which is guided from the chassis configuration, through the supporting frame 10, to an electronic activating unit 38 (not shown). On the outlet side of the mail stream, the supporting frame 10 has a rectangular box that is bounded by side walls and has a base plate 100. The latter has, counter to the X-direction, in the vicinity of the front side, an opening 101 for the pressure-exerting mechanism (not shown) for conveying an item of mail in the transporting direction Z.

The protective sheath 9 includes a flattened tubular element 94 and, at one end, merges into a cap 90 for covering the electronic activating unit 38. The tubular element 94 is constructed for accommodating a strip conductor 34 and preferably has a disengageable form-fitting connection with the cap 90, which is constructed for strain release. A bead-like collar 95 is formed, for example, on the tubular element 94 and the cap 90 has a concealed opening 91 for the through-passage of the tubular element 94 through the cap 90 from the side of the electronic activating unit 38 to the side of the printed circuit board 14. The cap 90 is constructed for fastening on the printing module 30, the fastener being disposed such that the latter are inaccessible from the access through the opening 24. The cap 90 has, for example, side walls 92, 93 with an opening 96. A screw 97, which can be screwed into the opening, serves for fastening on the printing module 30.

At the other end, the protective sheath 9 leads to a covering plate 99, which can be fastened on the supporting frame 10 and is constructed for strain release and for covering the openings in the top chassis part 15. The fastener for the covering plate 99 on the supporting frame 10 (the fastener not being illustrated specifically) are likewise disposed such that they are inaccessible from the access through the opening 24. A slot-like opening 98 in the covering plate 99 is provided for the through-passage of the tubular element 94, the covering plate 99 being constructed for strain release in the direction counter to the Y-direction. The tubular element 94 is connected in a form-fitting and force-fitting manner to the covering plate 99 by way of a particular shaping or S-shaped lead-through between the covering plate 99 and the base 1590 of the box 159 of the top chassis shell 15. The tubular element 94 is produced in flexible form, for example, from a particularly resistant plastic.

It is alternatively possible for the covering plate 99 and cap 90 to be integrally formed on the protective sheath 9 during production and to be produced from the same material.

Figure 9:
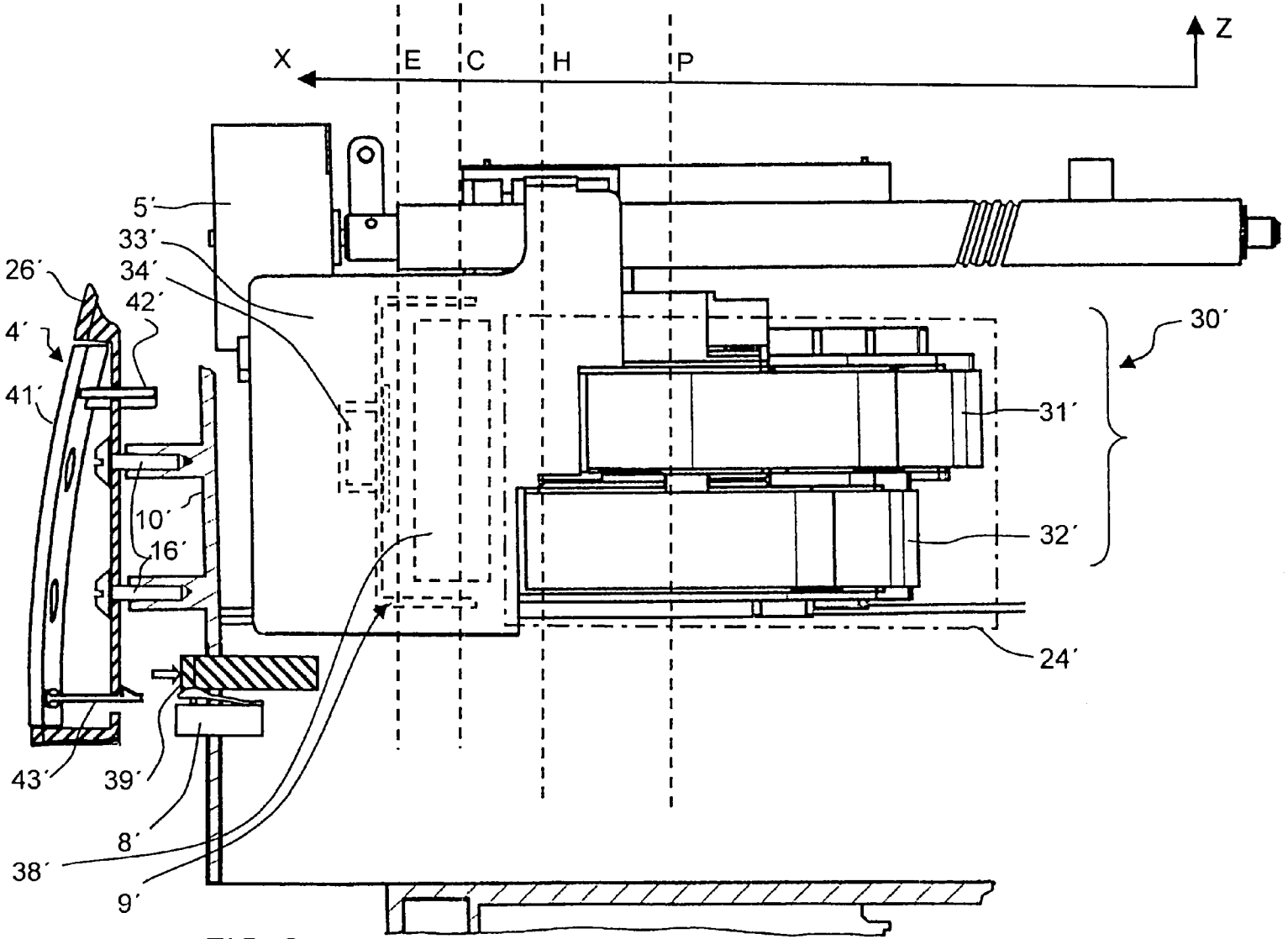
FIG. 9 is a left side view showing a security-housing part for barring, and a protective configuration for restricting, the access to the interior for the purpose of changing an ink cartridge.

FIG. 9 shows an alternative variant with a security-housing part 4' which bars the user from a first access to the interior of the mail-processing machine and has a protective configuration 8', 9', 33' which provides a second restricted access at any time for the purpose of changing an ink cartridge. The security-housing part 4' covers over a disengageable further lock, which is disposed on a wall, for example of the top housing part, which is located in the interior of the security housing, in order for the security housing to be locked or unlocked manually. The disengageable further lock, for example, a screw 16' which can be screwed into the supporting frame 10' or into a chassis part. Disposed on the security-housing part 4' is at least one mechanical locking element 43' that includes a resilient extension arm with a hook nose 432' at its end, it being possible for the hook nose to be brought into engagement with the abovementioned wall located in the interior of the security housing, and it only being possible for the security-housing part 4' to be removed with destruction being evident. In comparison with the variant shown in FIGS. 5A and 5B, the plate-like stop 433 on the locking element 43 and also the lever 37 are thus dispensed with. The security-housing part 4' preferably has an access-prevention plate 41' and guide and locking elements 42', 43'.

In combination with this alternative variant, it is also provided that the top security-housing part has an opening 24' which allows the user, for the purpose of changing an ink cartridge 31', 32', a second access to the interior of the mail-processing machine, and that the opening 24' can be closed by a flap which is provided with a stop 39' which, when the flap is opened, actuates a switch 8' which is disposed in the interior of the security housing, the power supply to a motor 5' of the transverse mover of the printing module 30' being interrupted. In comparison with the variant shown in FIG. 6, the lever 37 is thus dispensed.

When the flap 3 (FIG. 1A) is opened, the switch 8 used is, for example, a microswitch that is disposed in the interior of the security housing and is connected electrically to the printed circuit board 14 (FIG. 7). The latter bears the electronic control for printing, for example, with a franking machine and can interrupt the power supply to a motor 5' of the transverse mover of the printing module 30' in order to prevent the printing module 30' from moving transversely. The motor 5' is connected in control terms to the printed circuit board. In a sub-variant, the motor 5' is connected electrically to the printed circuit board via the switch 8' and can be de-energized directly when the flap is opened. It is only in the case where the ink cartridge 31', 32' has been positioned in the vicinity of the printing position, or directly in the latter, that the cartridge cannot be exchanged. In any other case, the transversely moveable printing module having been displaced into a position outside the printing position and the flap then having been opened, it is possible for an ink cartridge 31', 32' positioned in the region of the opening 24' to be exchanged. An empty or non-functioning ink cartridge 31', 32' can be exchanged at any time. In order to protect against manipulation of the franking machine via the opening 24', and to cover the electronic activating unit 38' from above, the protective cap 33' prevents access to the strip conductor 34' and the control lines in the electronic activating unit 38'. In any position into which the printing module 30' can be brought, and access to the strip conductor 34' and the control lines would be possible, the abovementioned opening 24' is at least partially, or completely, closed by the protective cap 33'.

The invention is not restricted to the present embodiments. Rather, a number of variants are conceivable within the context of the claims. It is thus obviously possible to develop and use other configurations of the invention which, based on the same basic idea of the invention, are covered by the attached claims.

We claim:

1. A method of opening a security housing, with authorization and unlocking, which comprises the following steps:

providing a print module being movable along a mail-transporting direction for carrying out a franking operation across a displacement path, the printing module also being transversely movable by a mover;

bringing the printing module into an unlocked position by moving the printing module in a direction transverse to the mail-transporting direction; and releasing mechanically a lock of a security-housing part in an interior of the security housing by engaging said lock with an actuating finger disposed on the printing module.

2. The method according to claim 1, which further comprises, after releasing mechanically the security-housing part, preventing activation of an ink-jet printing head of an ink cartridge.

3. The method according to claim 2, which further comprises checking if the security housing of the postal machine is released or locked.

4. The method according to claim 3, which further comprises confining if the security housing of the postal machine is locked.

5. The method according to claim 4, which further comprises, after confirming that the postal machine is locked, operating the postal machine for franking items of mail.

6. The method according to claim 1, which further comprises:

displacing the printing module from at least one of a home position and a printing position, into the unlocked position for releasing a top part of the security housing; and then displacing the printing module into a changeover position for changing the ink cartridge.

7. The method according to claim 6, which further comprises:

forming the printing position and the unlocked position at end points of a displacement path of the printing module; and positioning the ink-cartridge changeover position between the printing position and the unlocked position.

8. The method according to claim 6, which further comprises:

forming the printing position and the unlocked position at end points of a displacement path of the printing module; and positioning the ink-cartridge changeover position between the home position and the unlocked position.

9. A method of opening a security housing, with authorization and unlocking, which comprises the following steps:

providing a print module being movable along a mail-transporting direction for carrying out a franking operation across a displacement path, the printing module also being transversely movable by a mover;

bringing the printing module into an unlocked position by moving the printing module in a direction transverse to the mail-transporting direction; and releasing mechanically a lock of a security-housing part in an interior of the security housing by engaging said lock with an actuating finger disposed on the printing module.

10. The method according to claim 1, which further comprises:

providing a further access for changing an ink cartridge;

releasing mechanically the further access when changing the ink cartridge; and locking the further access before operating the postal machine.

11. The method according to claim 9, which further comprises:

allowing an authorized individual to reach components within the security housing for repair and maintenance purposes through the access, after the releasing step;

providing a further access for reaching an ink cartridge; and releasing mechanically the further access to a security-housing part by completing the bringing step.

12. The method according to claim 11, which further comprises releasing mechanically the further access for changing the ink cartridge when the printing module passes through a changeover position during the moving of the printing module in the direction transverse to the mail-transporting direction.

13. The method according to claim 9, which further comprises releasing mechanically the access to a lock of the security housing.

14. The method according to claim 9, which further comprises after releasing mechanically the access to the security-housing part, preventing activation of an ink-jet printing head of an ink cartridge.

15. The method according to claim 14, which further comprises confirming it the security housing of the postal machine is locked.

16. The method according to claim 15, which further comprises, after the confirming step, operating the postal machine for franking items of mail if the postal machine is locked.

17. The method according to claim 9, which further comprises:

providing a further access for changing the ink cartridge; releasing mechanically the further access when changing the ink cartridge; and locking the further access before operating the postal machine.

18. The method according to claim 9, which further comprises:

displacing the printing module from at least one of a home position and a printing position, into an unlocked position for releasing a first access to the security housing; and then displacing the printing module into a changeover position for changing the ink cartridge.

19. The method according to claim 18, which further comprises:

forming the printing position and the unlocked position at end points of a displacement path of the printing module; and positioning the ink-cartridge changeover position between the printing position and the unlocked position.

20. The method according to claim 18, which further comprises:

forming the printing position and the unlocked position at end points of a displacement path of the printing module; and positioning the ink-cartridge changeover position between the home position and the unlocked position.

21. A configuration for franking device security, comprising:

a security housing having a mechanical locking device and defining an interior;

a printing module movable along a transporting direction for carrying out the franking operation across a displacement path, said printing module being also movable by a mover transversely to the transporting direction, said printing module being movable into an unlocked position located at an end of the displacement path;

a mechanical lock disposed on a respective security-housing part in said interior of said security housing; and a finger disposed on said printing module for actuating said mechanical lock when said printing module is moved by said mover.

22. The configuration according to claim 21, wherein:

said mechanical lock is a snap-in connection; and said finger directly actuates said mechanical lock for releasing said security-housing part.

23. The configuration according to claim 21, wherein:

said security housing has walls, each with an inside;

said mechanical lock is a snap-in connection disposed on said inside of at least one of said walls of said security housing; and said mechanical lock is indirectly actuatable by said finger to mechanically release said security-housing part; and a force transmitter transmitting drive power of said transverse mover to said lock when said printing module is brought into said unlocked position.

24. The configuration according to claim 23, wherein said farce-transmitter is selected from the group consisting of a lever and a cable pull.

25. The configuration according to claim 21, wherein said releasable security-housing part is a top security-housing part.

26. The configuration according to claim 25, wherein:

said releasable top security-housing part has an opening formed therein;

a second access for changing an ink cartridge is accessible through said opening when said printing module is positioned in said ink-cartridge changeover position;

said printing module has a printing carriage with an electronic activating unit and a strip conductor and a protective cap being at least partially closeable by said second access to prevent access to said connection lines of said strip conductor and said electronic activating unit when said printing module is positioned outside said ink-cartridge changeover position.

27. The configuration according to claim 26, wherein said protective cap is fastened on said printing carriage to mechanically release at least one of said top-security housing and an access to said top-security housing.

28. The configuration according to claim 26, wherein said printing carriage has a corresponding finger to mechanically release at least one of said top security-housing part or said access to said top security-housing.

29. The configuration according to claim 26, further comprising:

a second finger on said lever; and a flap for closing said opening and having a stop, said stop being locked by said second finger of said lever when said printing module is positioned in said ink-cartridge changeover position.

30. The configuration according to claim 26, further comprising:

a second finger on said lever; and a flap for closing said opening and having a stop, said stop being locked by said second finger of said lever when said printing module is positioned in said unlocked position.

31. The configuration according to claim 26, wherein said flap cannot be locked and said opening is always accessible.

32. The configuration according to claim 26, further comprising a protective sheath fastened on said printing module to prevent unauthorized access to said strip conductor and to said electronic activating unit.

33. The configuration according to claim 32, wherein said releasable security-housing part is a top security-housing part.

34. The configuration according to claim 33, wherein:

said releasable top security-housing part has an opening formed therein;

a second access for changing an ink cartridge is accessible through said opening when said printing module is positioned in said ink-cartridge changeover position;

said printing module has a printing carriage with an electronic activating unit and a strip conductor and a protective cap being at least partially closeable by said second access to prevent access to said connection lines of said strip conductor and said electronic activating unit when said printing module is positioned outside said ink-cartridge changeover position.

35. The configuration according to claim 34, wherein said protective cap is fastened on said printing carriage to mechanically release at least one of said top-security housing and an access to said top-security housing.

36. The configuration according to claim 34, wherein said printing carriage has a corresponding finger to mechanically release at least one of said top security-housing part or said access to said top security-housing.

37. The configuration according to claim 34, further comprising:

a second finger on said lever; and a flap for closing said opening and having a stop, said stop being locked by said second finger of said lever when said printing module is positioned in said ink-cartridge changeover position.

38. The configuration according to claim 34, further comprising:

a second finger on said lever; and a flap for closing said opening and having a stop, said stop being locked by said second finger of said lever when said printing module is positioned in said unlocked position.

39. The configuration according to claim 34, wherein said flap cannot be locked and said opening is always accessible.

40. The configuration according to claim 34, further comprising a protective sheath fastened on said printing module to prevent unauthorized access to said strip conductor and to said electronic activating unit.

41. A configuration for franking device security, comprising:

a security housing having a mechanical locking device and defining an interior;

a printing module movable along a transporting direction for carrying out the franking operation across a displacement path, said printing module being also movable by a mover transversely to the transporting direction, said printing module being movable into an unlocked position located at an end of the displacement path;

an element disposed on a respective security-housing part in said interior of said security housing; and a finger disposed on said printing module for actuating said element when said printing module is moved by said mover.

42. The configuration according to claim 41, wherein:

said security wall has a wall;

said locking element of said security-housing part has a resilient extension arm and a hook nose on said resilient extension arm;

said printing module moves transversely to actuate directly said locking element into the unlocked position; and an access to a further disengageable lock of said security-housing part being released mechanically when said locking element is actuated, said further lock being provided at least on said wall of said security housing for manually locking or unlocking said security-housing part.

43. The configuration according to claim 41, wherein:

said security-housing part with said mechanical locking element is an access-prevention part providing an access to a housing part, said access being releaseable and closeable by a further disengageable lock; and said finger for actuating said mechanical locking element indirectly is formed via a force-transmitter disposed between said finger and said mechanical locking element.

44. The configuration according to claim 42, wherein:

said force transmitter is a lever deflectable in the Z-direction at a first end and has a finger pressing on said plate-like stop of said mechanical locking element by a force when said lever is deflected sufficiently into the unlocked position in the X-direction by said printing module moving transversely; and said lever has a swivel pin in a Y-direction, in a vicinity of said wall on said front side of said security housing, at a second end and in the X-direction, at a distance from said swivel pin, and an extension element bearing a spring for resiliently supporting said lever on said chassis side part, to press said lever, by said guide element, onto said finger of said printing module.

45. The configuration according to claim 42, further comprising:

an access-prevention plate of said access-prevention part for closing said access to said releasable safety-housing part;

said access-prevention part having said guide and locking elements and directed into said housing interior.

46. The configuration according to claim 41, wherein said further disengageable lock is screws; and a chassis part is fastened on said releasable security-housing part by said screws.

47. The configuration according to claim 42, wherein:

said releasable security housing has a compartment;

said access-prevention plate has a an access-prevention plate, said access-prevention plate having a further guide element rigidly fitted thereon;

said mechanical locking element has a plate-like form and a hock nose, said hook nose being latchable resiliently into said compartment of said releasable security-housing part, and said mechanical locking element is fitted on said access-prevention plate;

said compartment having a base with openings formed therein being, said opening being formed to correspond to the shape of said locking element and of said further guide element.

48. The configuration according to claim 47, wherein:

said locking element has a spring plate integrally formed on said access-prevention plate; and said hook nose is separated from said access-prevention plate by a distance;

said spring plate merging into a plate-like stop as the distance from the access-prevention plate increases.

* * * * *